US006705923B2

(12) United States Patent
Liu et al.

(10) Patent No.: US 6,705,923 B2
(45) Date of Patent: Mar. 16, 2004

(54) CHEMICAL MECHANICAL POLISHER EQUIPPED WITH CHILLED WAFER HOLDER AND POLISHING PAD AND METHOD OF USING

(75) Inventors: Chi-Wen Liu, Hsinchu (TW); Ying-Lang Wan, Taichung (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/132,446

(22) Filed: Apr. 25, 2002

(65) Prior Publication Data

US 2003/0203708 A1 Oct. 30, 2003

(51) Int. Cl.[7] ..... B24B 1/00
(52) U.S. Cl. ..... 451/7; 451/53; 451/287
(58) Field of Search ..... 451/7, 53, 285–289, 451/397–399; 438/692–693

(56) References Cited

U.S. PATENT DOCUMENTS 5,104,828 A * 4/1992 Morimoto et al. ..... 438/633
5,873,769 A * 2/1999 Chiou et al. ..... 451/7
6,077,151 A * 6/2000 Black et al. ..... 451/53
6,121,144 A * 9/2000 Marcyk et al. ..... 438/692
6,217,426 B1 * 4/2001 Tolles et al. ..... 451/285
6,299,516 B1 * 10/2001 Tolles ..... 451/287
6,358,119 B1 * 3/2002 Shih et al. ..... 451/36
6,416,384 B1 * 7/2002 Kawamoto et al. ..... 451/7
6,485,359 B1 * 11/2002 Li et al. ..... 451/289

* cited by examiner

*Primary Examiner*—George Nguyen
(74) *Attorney, Agent, or Firm*—Tung & Associates

(57) ABSTRACT

A chemical mechanical polisher that is equipped with a chilled wafer holder and a chilled polishing pad and a method for operating the chemical mechanical polisher are described. A first heat exchanging fluid is flown into a membrane chamber inside the wafer holder in intimate contact with the backside of the wafer such that the wafer can be sufficiently cooled. A second heat exchanging fluid is circulated in a plurality of surface grooves, or fluid channels provided in the bottom surface of the polishing pad to sufficiently cool the polishing pad during a chemical mechanical polishing process. The slurry suspension contained in-between the wafer surface and the polishing pad can thus be sufficiently cooled.

19 Claims, 3 Drawing Sheets

CHEMICAL MECHANICAL POLISHER EQUIPPED WITH CHILLED WAFER HOLDER AND POLISHING PAD AND METHOD OF USING

FIELD OF THE INVENTION

The present invention generally relates to a chemical mechanical polisher for polishing semiconductor wafers and a method of using and more particularly, relates to a chemical mechanical polisher that is equipped with a chilled wafer holder and polishing pad and a method for using the chemical mechanical polisher.

BACKGROUND OF THE INVENTION

Apparatus for polishing thin, flat semiconductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by a non-uniform pressure applied on a wafer. The problem is reduced somewhat through the use of a retaining ring which engages the polishing pad.

Referring now to FIG. 1C, wherein an improved CMP head 20, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

The enlarged cross-sectional representation of the polishing action which results form a combination of chemical and mechanical effects is shown in FIG. 1B. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate.

For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($Al_3O_2$) may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

Referring now to FIG. 1D, wherein a perspective view of a CMP polishing station 42 is shown. The polishing station 42 consists of a conditioning head 52, a polishing pad 28, and a slurry delivery arm 54 positioned over the polishing pad. The conditioning head 28 is mounted on a conditioning arm 58 which is extended over the top of the polishing pad 28 for making sweeping motions across the entire surface of the pad. The slurry delivery arm 54 is equipped with a single slurry dispensing nozzle 62 which is used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

In a typical polishing slurry composition of a colloidal suspension of particles, a dispersion agent is added to facilitate the distribution of the particles in the suspension. During a chemical mechanical polishing process, the temperature of the slurry gradually increases by to the mechanical heat generated between the polishing pad, the wafer surface and the slurry particles. The increased temperature of the slurry affects the efficiency of the dispersion agent and as a result, large agglomerates of particles are formed in the slurry suspension. These agglomerates have sizes substantially larger than the surface grooves provided in the polishing pad and thus, cannot be trapped by the surface grooves. The agglomerates of particles can thus become a serious source of contamination leading to significant scratches on the wafer surface. A major scratch on the wafer surface may cause the scrap of the entire wafer.

It is therefore an object of the present invention to provide a chemical mechanical polisher that does not have the scratching defect caused by the formation of large slurry particle agglomerates.

It is another object of the present invention to provide a chemical mechanical polisher that is equipped with a chilled wafer holder and a chilled polishing pad.

It is a further object of the present invention to provide a chemical mechanical polisher wherein any increase in temperature of a slurry solution is controlled.

It is another further object of the present invention to provide a chemical mechanical polishing method without scratching defects caused by the formation of large slurry particle agglomerates.

It is still another object of the present invention to provide a chemical mechanical polishing method by flowing a cooling fluid into a wafer holder and a polishing pad such that the temperature increase of the slurry solution can be controlled.

It is yet another object of the present invention to provide a chemical mechanical polishing method by flowing a high heat capacity fluid into a wafer holder and a polishing pad for controlling the temperature rise of the holder and the pad.

SUMMARY OF THE INVENTION

In accordance with the present invention, a chemical mechanical polisher that is equipped with a chilled wafer holder and polishing pad and a method of using the polisher are provided.

In a preferred embodiment, a chemical mechanical polisher that is equipped with a chilled wafer holder and polishing pad is provided which includes a polishing head that has a retaining ring chamber for pressing a retaining ring downwardly, the retaining ring defines a membrane chamber therein for contacting and pressing a wafer downwardly onto a polishing pad; the membrane chamber receives a first heat exchanging fluid for removing heat from the wafer during a polishing process; and a pedestal for mounting a polishing pad on a top surface, the polishing pad has a bottom surface provided with fluid channels for circulating a second heat exchanging fluid therein, the second heat exchanging fluid being fed into the fluid channels through a fluid passageway in the pedestal for removing heat from the polishing pad.

In the chemical mechanical polisher that is equipped with a chilled wafer holder and polishing pad, the membrane chamber may further include an inlet and an outlet for the first heat exchanging fluid, the polisher may include at least one fluid reservoir for holding the first and the second heat exchanging fluid, the polisher may further include a temperature controller for controlling the temperature of the first and second heat exchanging fluid. The first heat exchanging fluid may be water. The polisher may further include a temperature controller for controlling the temperature of the first heat exchanging fluid to not higher than 23° C., and preferably to not higher than 18° C. The first and the second heat exchanging fluids may be the same, or may be different.

The present invention is further directed to a chemical mechanical polishing method that is without scratching defect caused by large slurry particle agglomerates which can be carried out by the operating steps of first providing a polishing head equipped with a retaining ring chamber and a membrane chamber situated inside the retaining ring chamber; mounting a wafer on the membrane chamber with a surface to be polished exposed; flowing a first heat exchanging fluid into the membrane chamber for pressing the wafer in a downward direction onto a polishing pad and for removing heat during a polishing operation; providing a pedestal for holding a polishing pad thereon; forming a plurality of flow channels on a bottom side of the polishing pad for intimately contacting a top surface of the pedestal; and flowing a second heat exchanging fluid into the plurality of flow channels and removing heat from the polishing pad during a polishing process such that the generation of large slurry particle agglomerates is avoided.

The chemical mechanical polishing method that is without scratching defect caused by large slurry particle agglomerates may further include the step of providing fluid passageways in the pedestal for flowing the second heat exchanging fluid into the plurality of flow channels. The method may further include the step of selecting the first heat exchanging fluid from one that has a heat capacity of at least that of water. The method may further include the step of flowing the first heat exchanging fluid of water at a temperature not higher than 23° C. into the membrane chamber, or flowing the first heat exchanging fluid of water at a temperature preferably not higher than 18° C. into the membrane chamber. The method may further include the step of selecting the second heat exchanging fluid the same as the first heat exchanging fluid, or selecting the second heat exchanging fluid different than the first heat exchanging fluid. The method may further include the step of forming the plurality of flow channels on the bottom side of the polishing pad to a depth that is not larger than ¾ of the thickness of the pad. The method may further include the step of providing a fluid inlet and a fluid outlet on the membrane chamber.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a chemical mechanical polisher that is equipped with a chilled wafer holder and a chilled polishing pad which can be used to carry out a chemical mechanical polishing process without scratching defect caused by the large slurry particle agglomerates generated when the slurry temperature is not controlled. The invention further discloses a chemical mechanical polishing method that can be carried out without scratching defect by large slurry particle agglomerates which would otherwise be produced by heated slurry solution during the polishing process.

The present invention novel method and apparatus utilizes a unique backside flow channel design in a polishing pad to increase heat removal, while simultaneously, flowing a high heat capacity fluid, i.e. water, into the membrane chamber of a wafer holder to increase heat removal from the wafer. Any temperature increase in the slurry suspension during the polishing process can thus be controlled such that the formation of large slurry particle agglomerates can either be significantly reduced or can be completely eliminated.

Figure 1A:
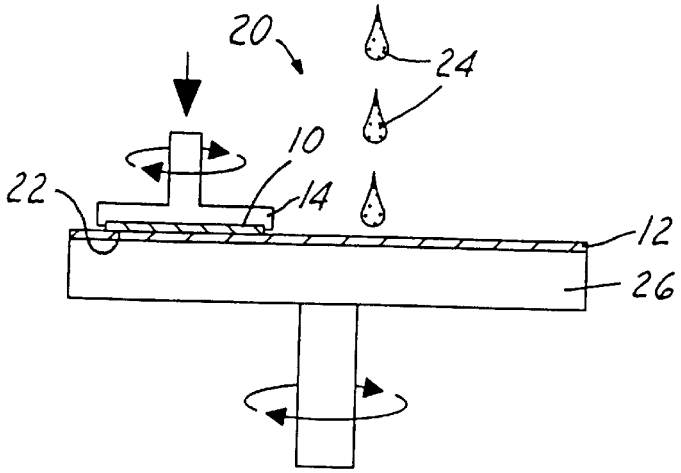
(Prior Art) FIG. 1A
FIG. 1A is a cross-sectional view of a conventional chemical mechanical polishing apparatus.
Figure 1B:
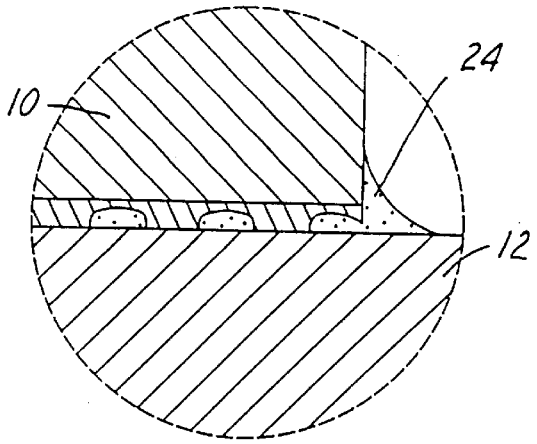
(Prior Art) FIG. 1B
FIG. 1B is an enlarged, cross-sectional view illustrating the interaction between the wafer surface, the polishing pad and the slurry solution.
Figure 1C:
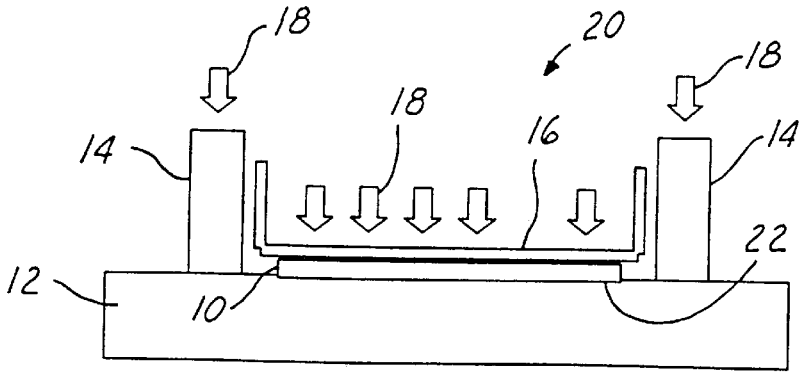
(Prior Art) FIG. 1C
FIG. 1C is a cross-sectional view of a conventional membrane-pressured wafer holder for the CMP apparatus.
Figure 1D:
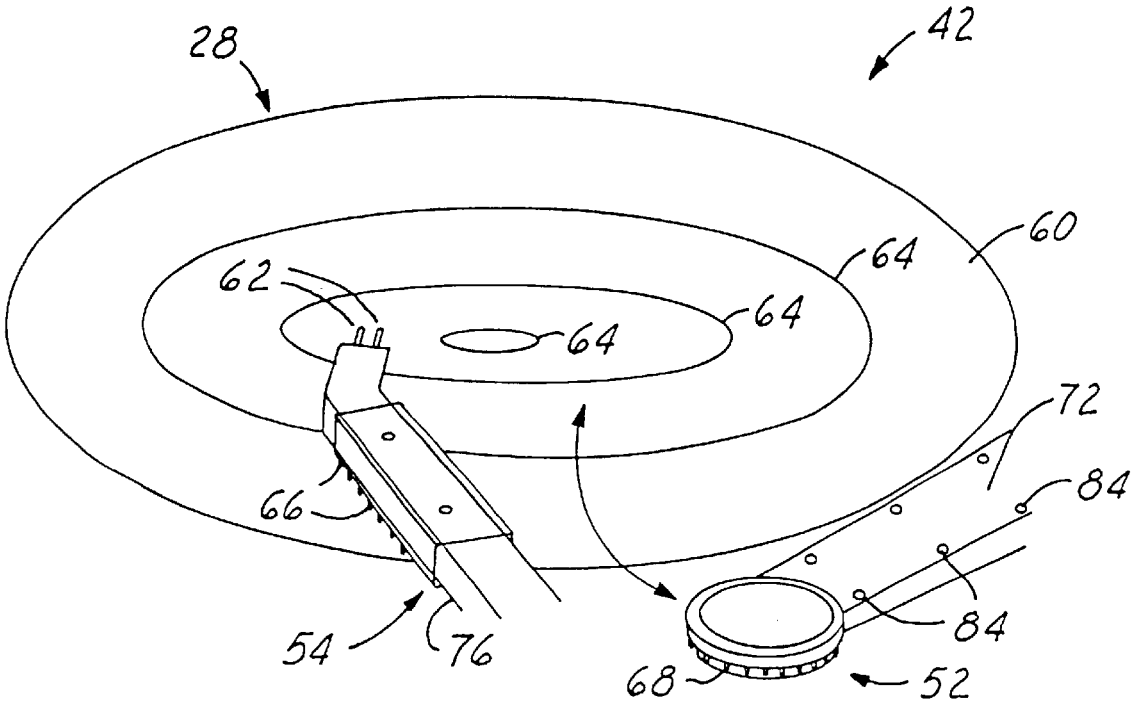
(Prior Art) FIG. 1D
FIG. 1D is a perspective view of a conventional CMP apparatus with a slurry dispenser and a conditioning arm positioned on top of the polishing pad.
Figure 2:
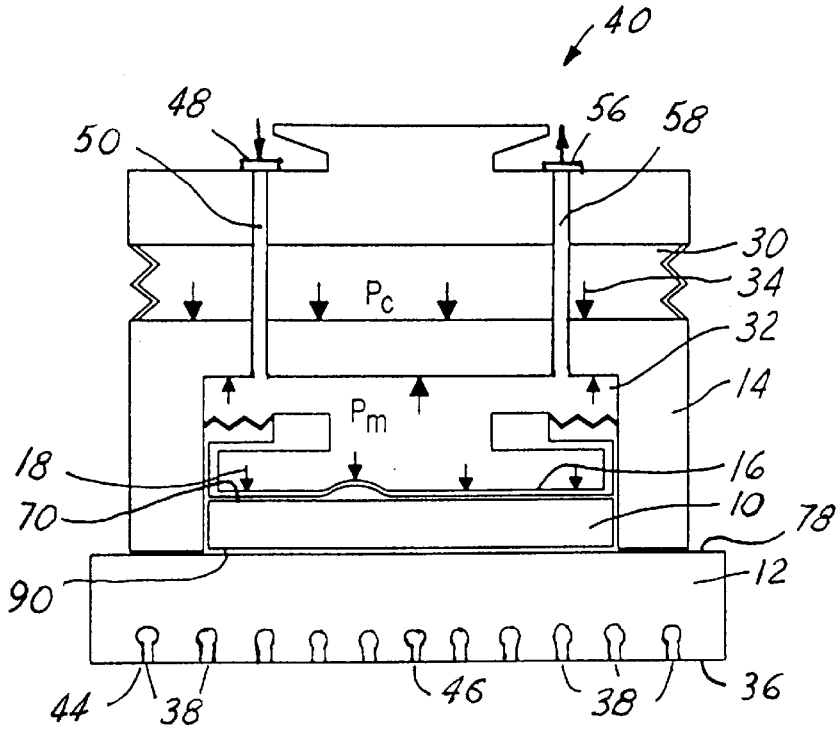
FIG. 2 is a cross-sectional view of the present invention chemical mechanical polishing apparatus equipped with a chilled wafer holder and a chilled polishing pad.

Referring now to FIG. 2, wherein a present invention wafer holder 40 and a polishing pad 12 are shown in a cross-sectional view. Two separate pressure chambers of a retaining ring chamber 30 and a membrane chamber 32 are used during a polishing process. A retaining ring pressure 34 exerts on the retaining ring 14, while a membrane pressure 18 translates into wafer backside pressure. Generally, the wafer retaining pressure in the wafer holder 40 is a function of both the membrane pressure 18 and the retaining ring pressure 34.

The polishing pad 12 is generally fabricated of a rigid polymeric material with surface grooves (not shown in FIG. 2) provided in a top surface. In the present invention polishing pad 12, a plurality of fluid channels 38 is formed in a bottom surface 36 that is in contact with a pedestal (not shown in FIG. 2). The plurality of fluid channels 38 allows the circulation of a heat exchanging fluid therethrough when in fluid communication with fluid passageways provided in the pedestal. A fluid inlet 44 and a fluid outlet 46 are further provided for flowing the heat exchanging fluid into and out of the plurality of surface grooves 38. A suitable heat exchanging fluid should have a sufficiently high heat capacity, i.e. at least that of water, such that heat can be efficiently carried away from the otherwise low thermal conductivity polymeric material that is frequently used to fabricate the polishing pad 12. The cooled or chilled polishing pad 12 can therefore efficiently reduce the temperature of the slurry suspension deposited thereon during a chemical mechanical polishing process.

A second important aspect of the present invention is the chilled wafer holder 40 achieved by flowing into the membrane chamber 32 a first heat exchanging fluid through an inlet 48 and a fluid passageway 50, and out of the membrane chamber 32 through an outlet 56 and a fluid passageway 58. A suitable first heat exchanging fluid may be one that has a sufficiently high heat capacity, i.e. at least that of water. The first heat exchanging fluid not only provides the heat exchanging function by carrying away heat from the wafer backside 70, but also applying membrane pressure 18 onto the wafer 10 such that the active surface 90 of the wafer 10 intimately engages the top surface 78 of the polishing pad 12 during a chemical mechanical polishing process.

By combining the cooling, or chilling functions of the membrane chamber and the polishing pad, the present invention novel chemical mechanical polisher effectively reduces the temperature of the slurry suspension by at least 10° C. such that the temperature of the slurry suspension maintains at close to room temperature, i.e. at about 23° C. By sufficiently cooling the slurry suspension, any formation of large slurry particle agglomerates which are the major contamination source, can be avoided.

Figure 2A:
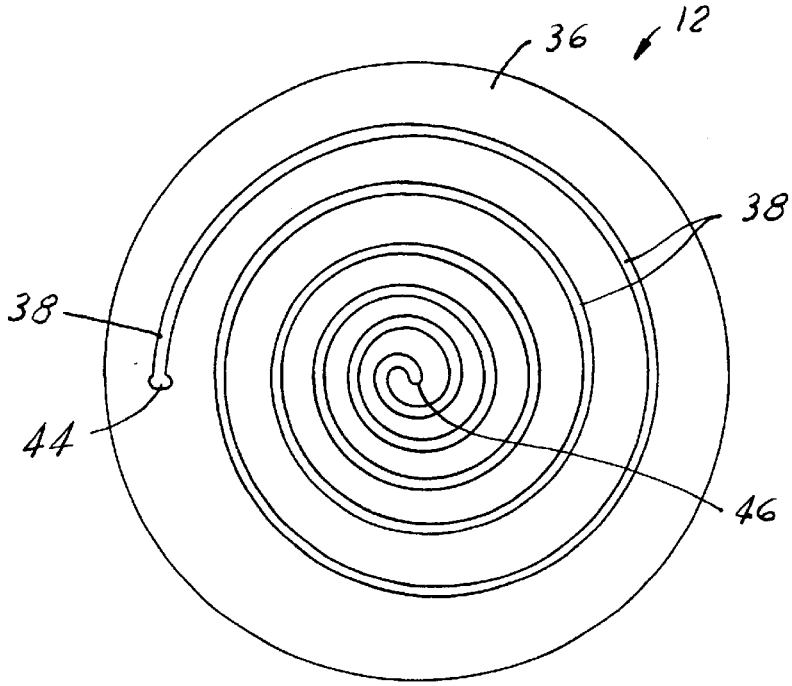
FIG. 2A is a bottom view of the polishing pad shown in FIG. 2 illustrating the flow channels on the backside of the pad.

The present invention chemical mechanical polisher that is equipped with a chilled wafer holder and a chilled polishing pad and a method for operating the chemical mechanical polisher have therefore been amply described in the above description and in the appended drawings of FIGS. 2 and 2A.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A chemical mechanical polisher equipped with chilled wafer holder and polishing pad comprising:

a polishing head having a retaining ring chamber for pressing a retaining ring downwardly, said retaining ring defines a membrane chamber therein for contacting and pressing a wafer downwardly onto a polishing pad; said membrane chamber receives a first heat exchanging fluid for removing heat from said wafer during a polishing process; and a pedestal for mounting a polishing pad on a top surface, said polishing pad having a bottom surface provided with fluid channels for circulating a second heat exchanging fluid therein, said second heat exchanging fluid being fed into said fluid channels through a fluid passageway in said pedestal for removing heat from said polishing pad.

2. A chemical mechanical polisher equipped with chilled wafer holder and polishing pad according to claim 1, wherein said membrane chamber further comprises an inlet and an outlet for said first heat exchanging fluid.

3. A chemical mechanical polisher equipped with chilled wafer holder and polishing pad according to claim 1 further comprising at least one fluid reservoir for holding said first and second heat exchanging fluid.

4. A chemical mechanical polisher equipped with chilled wafer holder and polishing pad according to claim 1 further comprising a temperature controller for controlling the temperature of said first and second heat exchanging fluid.

5. A chemical mechanical polisher equipped with chilled wafer holder and polishing pad according to claim 1, wherein said first heat exchanging fluid is $H_2O$.

6. A chemical mechanical polisher equipped with chilled wafer holder and polishing pad according to claim 1 further comprising a temperature controller for controlling the temperature of said first heat exchanging fluid to not higher than 23° C.

7. A chemical mechanical polisher equipped with chilled wafer holder and polishing pad according to claim 1 further comprising a temperature controller for controlling the temperature of said first heat exchanging fluid of water to not higher than 23° C.

8. A chemical mechanical polisher equipped with chilled wafer holder and polishing pad according to claim 1 further comprising a temperature controller for controlling the temperature of said first heat exchanging fluid preferably to not higher than 18° C.

9. A chemical mechanical polisher equipped with chilled wafer holder and polishing pad according to claim 1, wherein said first and said second heat exchanging fluids are the same.

10. A chemical mechanical polisher equipped with chilled wafer holder and polishing pad according to claim 1, wherein said first heat exchanging fluid is different than said second heat exchanging fluid.

11. A chemical mechanical polishing method without scratching defect caused by large slurry particle agglomerates comprising the steps of:

providing a polishing head equipped with a retaining ring chamber and a membrane chamber situated inside said retaining ring chamber;

mounting a wafer on said membrane chamber with a surface to be polished exposed;

flowing a first heat exchanging fluid into said membrane chamber for pressing said wafer in a downward direction onto a polishing pad and for removing heat from said wafer during a polishing operation;

providing a pedestal for holding a polishing pad thereon;

forming a plurality of flow channels on a bottom side of said polishing pad for intimately contacting a top surface of said pedestal; and flowing a second heat exchanging fluid into said plurality of flow channels and removing heat from said polishing pad during a polishing process such that the generation of large slurry particle agglomerates is avoided.

12. A chemical mechanical polishing method without scratching defect caused by large slurry particle agglomerates according to claim 11 further comprising the step of providing fluid passageways in said pedestal for flowing said second heat exchanging fluid into said plurality of flow channels.

13. A chemical mechanical polishing method without scratching defect caused by large slurry particle agglomerates according to claim 11 further comprising the step of selecting said first heat exchanging fluid from one having a heat capacity of at least that of water.

14. A chemical mechanical polishing method without scratching defect caused by large slurry particle agglomerates according to claim 11 further comprising the step of flowing said first heat exchanging fluid of water at a temperature not higher than 23° C. into said membrane chamber.

15. A chemical mechanical polishing method without scratching defect caused by large slurry particle agglomerates according to claim 11 further comprising the step of flowing said first heat exchanging fluid of water at a temperature preferably not higher than 18° C. into said membrane chamber.

16. A chemical mechanical polishing method without scratching defect caused by large slurry particle agglomerates according to claim 11 further comprising the step of selecting the second heat exchanging fluid the same as said first heat exchanging fluid.

17. A chemical mechanical polishing method without scratching defect caused by large slurry particle agglomerates according to claim 11 further comprising the step of selecting the second heat exchanging fluid different than said first heat exchanging fluid.

18. A chemical mechanical polishing method without scratching defect caused by large slurry particle agglomerates according to claim 11 further comprising the step of forming said plurality of flow channels on said bottom side of the polishing pad to a depth not larger than ¾ of the thickness of the pad.

19. A chemical mechanical polishing method without scratching defect caused by large slurry particle agglomerates according to claim 11 further comprising the step of providing a fluid inlet and a fluid outlet on said membrane chamber.

* * * * *